US005632186A

United States Patent [19]

Lin

[11] Patent Number: 5,632,186

[45] Date of Patent: May 27, 1997

[54] REVERSIBLE SCREWDRIVER

[76] Inventor: Ching-Chou Lin, No. 150, Sec. 3, Chung Shan Rd., Wu Jin Hsiang, Taichung Hsien, Taiwan

[21] Appl. No.: 690,398

[22] Filed: Jul. 26, 1996

Related U.S. Application Data

[63] Continuation-in-part of Ser. No. 511,858, Aug. 7, 1995, abandoned.

[51] Int. Cl.[6] ..... B25B 13/00

[52] U.S. Cl. ..... 81/59.1; 81/177.4

[58] Field of Search ..... 81/59.1, 58, 177.4, 81/490

[56] References Cited

U.S. PATENT DOCUMENTS

| | | | |
|---|---|---|---|
| 1,878,053 | 9/1932 | Winger | 81/59.1 |
| 2,649,176 | 8/1953 | Winger | 81/58 |
| 3,006,395 | 10/1961 | Dye | 81/177.4 |
| 5,218,892 | 6/1993 | Napoli | 81/177.4 |
| 5,406,866 | 4/1995 | Badiali | 81/59.1 |

*Primary Examiner*—D. S. Meislin
*Assistant Examiner*—Joni B. Danganan
*Attorney, Agent, or Firm*—Bacon & Thomas

[57] ABSTRACT

A reversible screwdriver includes a handle, a screw cap and a socket respectively fastened to two opposite ends of the handle, a shaft fastened to a bottom center hole of the socket by a clamp, and a rotating knob mounted around the shaft for controlling the working direction of the shaft. The rotating knob includes a barrel mounted in a rectangular chamber inside the socket and has four longitudinal slots around the periphery and four round rods in the longitudinal slots for supporting the shaft, a hand wheel coupled to the barrel, a wire rod fastened to the barrel and moved by, the hand wheel relative to the triangular stop block of the socket to control the working direction of the shaft.

4 Claims, 5 Drawing Sheets

REVERSIBLE SCREWDRIVER

RELATED APPLICATIONS

This application is a continuation-in-part of U.S. Ser. No. 08/511,858 on filed Aug. 7, 1995, now abandoned.

BACKGROUND OF THE INVENTION

The present invention relates to reversible screwdrivers, and relates more particularly to such a reversible screwdriver which uses a socket and a rotating knob to control the working direction of the shaft.

A screwdriver is an important hand tool used for turning screws. However, conventional screwdrivers are inconvenient to use because the operator must lift the shaft from the workpiece upon each turn. Nowadays, various reversible ratchet screwdrivers have been disclosed, and have appeared on the market. These reversible ratchet screwdrivers can turn screws more efficiently because the handle runs idle when it is rotated in the reversed direction. FIG. 1 shows a reversible ratchet screwdriver according to the prior art. The handle of this reversible ratchet screwdriver comprises a chamber at one end, a plurality of slant grooves at two opposite ends of the chamber, a longitudinal center hole at the center of the bottom side of the chamber, and an arched groove on the bottom side of the chamber. A shaft is fastened to the chamber of the handle, having a bit coupling hole at one end for mounting a bit, and a ratchet wheel at an opposite end received inside the chamber of the handle. The ratchet wheel has a round rod at an outer side fitted into the longitudinal center hole of the handle. A locating plate is fastened to the arched groove of the handle to stop the shaft in place. Stop members are respectively and horizontally fastened to the slant grooves of the handle, each having a projecting tooth stopped between the ratchet wheel and the periphery of the chamber of the handle. A push block with a forked spring plate is mounted on the stop members. A socket is mounted around the shaft and fastened to the handle outside the chamber. By means of changing the position of the push block in the chamber, the working direction of the screwdriver is controlled. When the push block is moved to a predetermined position, the respective stop member is forced away, from the ratchet wheel by the forked spring plate of the push block, and therefore the ratchet wheel can be turned in one direction, and is prohibited from being turned in the reverse direction. When the push block is moved to the middle position, the ratchet wheel is locked and prohibited from rotary motion. This structure of reversible ratchet screwdriver is functional. However, the shaft tends to slip when the reversible ratchet screwdriver turns a big screw. Furthermore, this reversible ratchet screwdriver is not durable in use because the forked spring plate tends to be deformed.

SUMMARY OF THE INVENTION

According to one aspect of the present invention, a socket and a rotating knob are used to control the working direction of the reversible screwdriver, and four round rods are equiangularly spaced in the rotating knob within a substantially rectangular chamber of the socket to firmly support the shaft in place and to prohibit the shaft from slipping out of position.

According to another aspect of the present invention, a triangular stop block is made on the socket, and a wire rod is mounted on the barrel of the rotating knob and moved relative to the triangular stop block of the socket to shift the round rods so that the working direction of the reversible screwdriver is changed.

DETAILED DESCRIPTION OF THE PREFERRED EMBODIMENT

Figure 1:
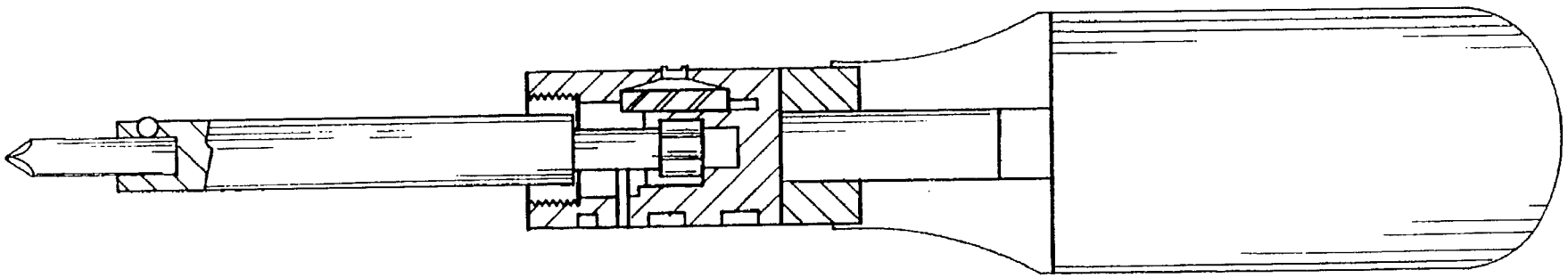
Fig. 1 PRIOR ART
FIG. 1 is a longitudinal view in section of a reversible screwdriver according to FIG. 2 is an exploded view of a reversible screwdriver according to the present invention.
Figures 2, 2A:
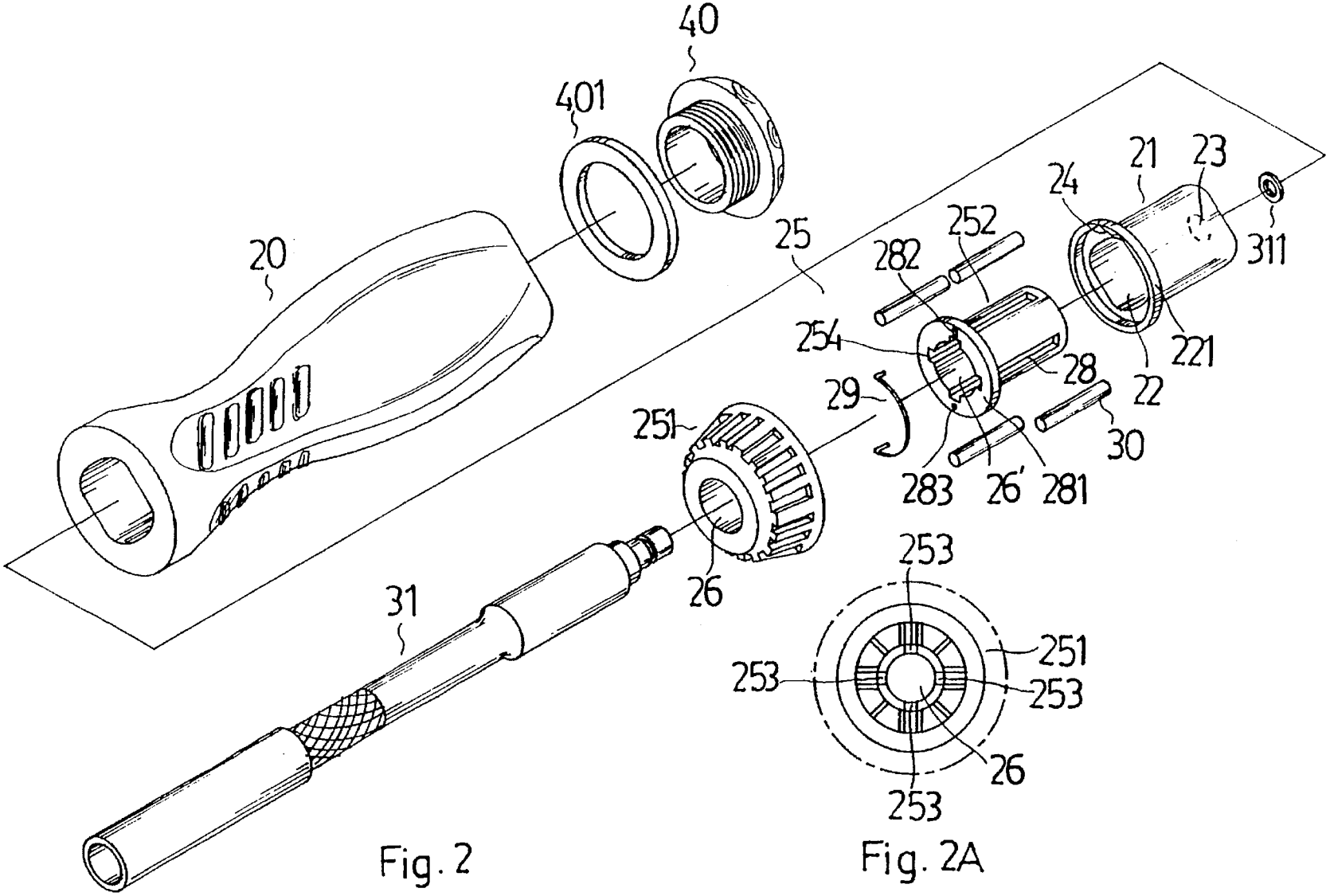
FIG. 2A is a cross sectional view of the hand wheel of the rotating knob according to the present invention.
Figure 3:
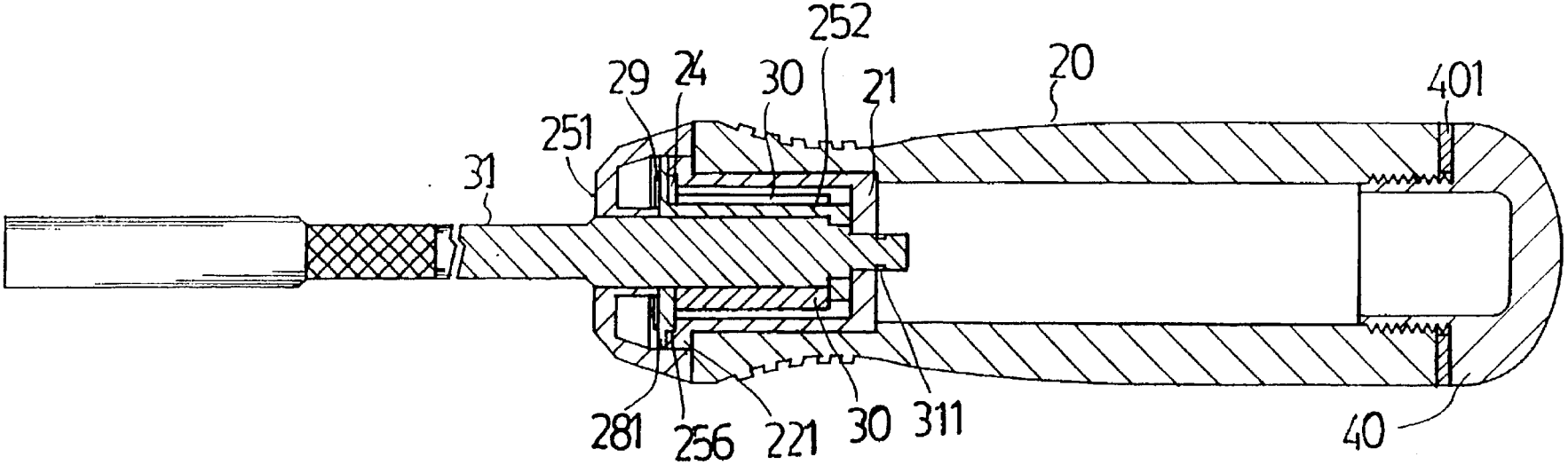
FIG. 3 is a longitudinal view in section of the reversible screwdriver shown in FIG. 2.

Referring to FIGS. 2 and 3, the present invention comprises a hollow handle 20, a screw cap 40 fastened to one end of the handle 20, a rubber ring 401 mounted around the screw cap 40 and stopped against the handle 20, a socket 21 fastened to an opposite end of the handle 20, a rotating knob 25 fastened to the socket 21, and a shaft 31 inserted through the rotating knob 25 and coupled to the socket 21. The socket 21 comprises a substantially rectangular chamber 22, a bottom center hole 23 at the center of the closed bottom side of the rectangular chamber 22 into which the shaft 31 is inserted and secured in place by a clamp 311, an outward annular flange 221 around the open front side of the rectangular chamber 22, and a triangular stop block 24 raised from the inside wall of the outward annular flange 221. The rotating knob 25 comprises a hand wheel 251, and a barrel 252 coupled to the hand wheel 25 1 and inserted into the rectangular chamber 22 of the socket 21. The hand wheel 251 and the barrel 252 have a respective longitudinal center through hole 26 or 26' for passing the shaft 31. The hand wheel 251 has a plurality of stop rods 253 spaced around the longitudinal center through hole 26. The barrel 252 comprises four longitudinal slots 28 equiangularly spaced around the periphery in communication with the longitudinal center through hole 26', a block 256 raised around one end of the longitudinal center through hole 26', an outward flange 281 connected to the block 256 at an outer side around the longitudinal center through hole 26', four equally spaced inside notches 254 respectively and longitudinally aligned with the longitudinal slots 28 for engagement with the stop rods 253 of the hand wheel 251, an inside longitudinal groove 282 on the outward flange 281 corresponding to the triangular stop block 24 of the socket 21, a locating hole 283 on the outward flange 281 opposing the inside longitudinal groove 282, a substantially, arched wire rod 29 having one end fastened to the locating hole 283 and an opposite end fastened to the inside longitudinal groove 282, and four round rods 30 respectively inserted into the longitudinal slots 28 and revolvably attached to the four angles of the rectangular chamber 22 of the socket 21. When the barrel 252 is coupled to the hand wheel 251, the outward flange 281 is received inside the hand wheel 251, and a potential difference exists between the bottom side of the hand wheel 251 and the bottom side of the outward flange 281. Furthermore, the four angles of the rectangular chamber 22 of the socket are smoothly chamfered. When assembled, one lateral side of the triangular stop block 24 of the socket 21 faces one end of the wire rod 29 in the longitudinal groove 282, the outward flange 221 of the socket 21 is retained between the outward flange 281 of the barrel 252 and the hand wheel 251; the block 256 of the barrel 252 is retained within the outward annular flange 221 of the socket 21; the wire rod 29 is disposed at one side relative to the triangular stop block 24; the round rods 30 are disposed around the four angles of the rectangular chamber 22 of the socket 21, and can only, be rotated in one direction. By turning the hand wheel 251, the position of the wire rod 29 is changed relative to the triangular stop block 24 of the socket 21.

Figure 4A:
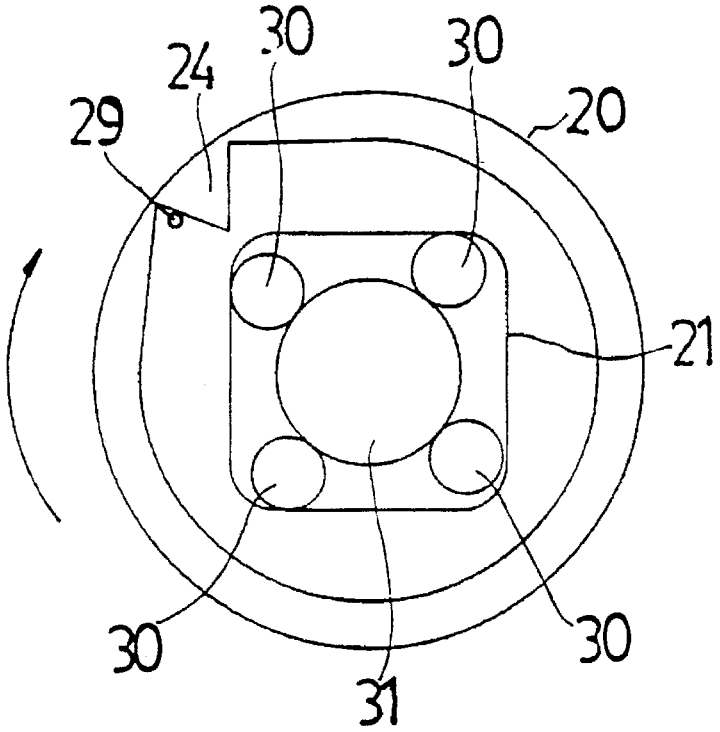
FIG. 4A is a cross sectional view in an enlarged view of the reversible screwdriver shown in FIG. 2, showing the wire rod moved to the left side relative to the triangular stop block, and the handle run idle in the counter-clockwise direction.

Referring to FIG. 4A, when the wire rod 29 is moved to the left side relative to the triangular stop block 24, the round rods 30 are stopped against the inside wall of the rectangular chamber 22 of the socket 21 at the left side relative to each angle of the rectangular chamber 22, and the shaft 31 runs idle when turned in the counterclockwise direction. Therefore, the shaft 31 can be turned by the handle 20 in the clockwise direction to turn the workpiece. When the handle 20 is rotated in the reversed direction, the shaft 31 does not work.

Figure 4B:
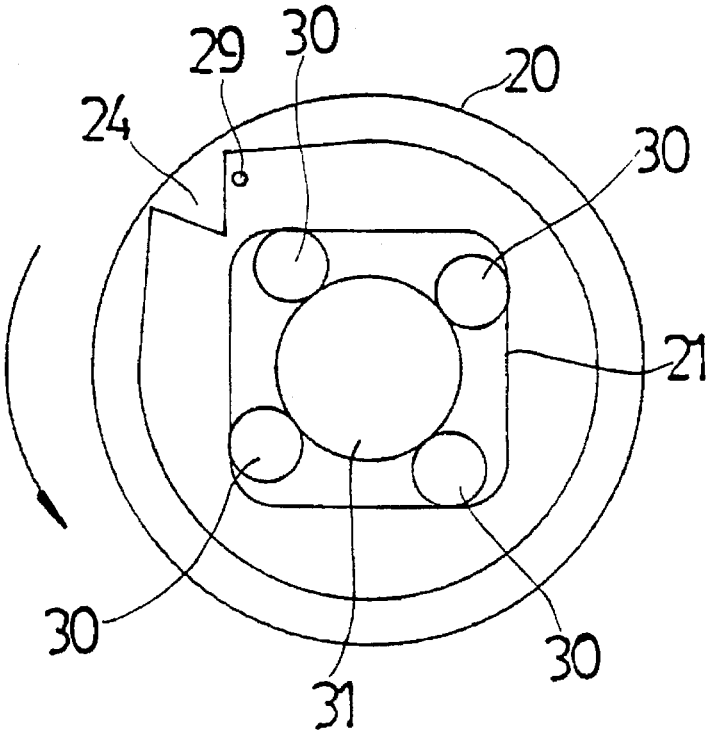
FIG. 4B is similar to FIG. 4A, but showing the wire rod moved to the right side relative to the triangular stop block, and the handle run idle in the clockwise direction.
Figure 5:
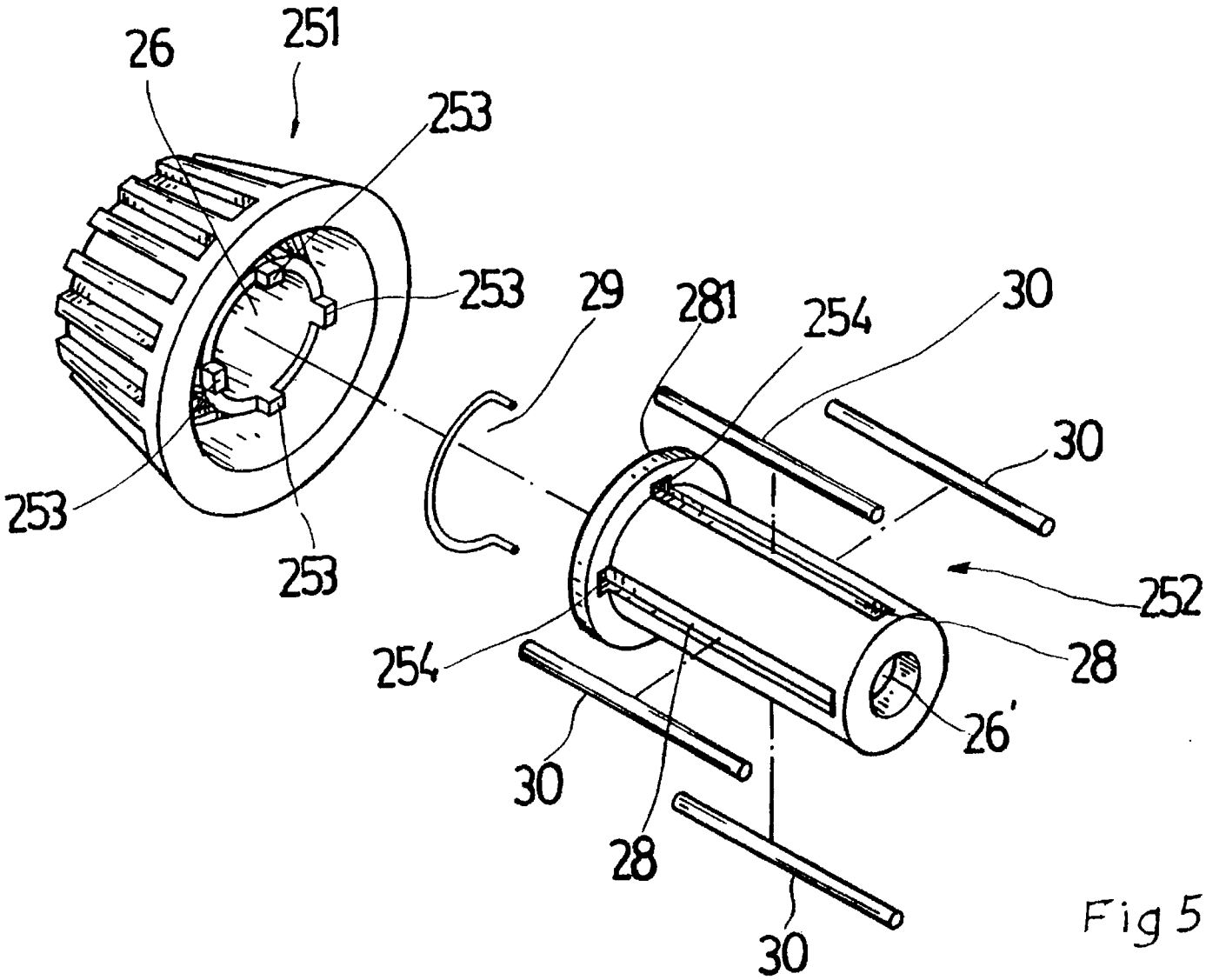
FIG. 5 is a partial, exploded perspective view of the handwheel and barrel.

Referring to FIG. 4B, when the wire rod 29 is moved to the right side relative to the triangular stop block 24, the round rods 30 are stopped against the inside wall of the rectangular chamber 22 of the socket 21 at the right side relative to each angle of the rectangular chamber 22, and the shaft 31 runs idle when mined in the clockwise direction. Therefore, the shaft 31 can be turned by the handle 20 in the counter-clockwise direction to mm the workpiece. When the handle 20 is rotated in the reversed direction, the shaft 31 does not work.

As indicated, by changing the position of the wire rod 29 relative to the triangular stop block 24, the working direction of the shaft 31 is controlled. Because the round rods 30 are equiangularly spaced within the rectangular chamber 22 of the socket 21, the shaft 31 is firmly supported in place and will not slip out of position. Furthermore, when the screw cap 40 is detached from the hollow handle 20, a variety of shafts can be stored in the hollow handle 20.

I claim:

1. A reversible screwdriver comprising:

a hollow handle having a first end covered with a screw cap, and a second end;

a socket fastened to the second end of said handle, said socket comprising a substantially rectangular chamber, said rectangular chamber having four angles smoothly chamfered, a bottom center hole, an outward annular flange around said rectangular chamber at one end remote from said handle, and a triangular stop block raised above an inside portion of said outward annular flange;

a rotating knob coupled to said socket, said rotating knob comprising a hand wheel disposed outside said handle and said socket, and a barrel coupled to said hand wheel and inserted into said rectangular chamber of said socket, said hand wheel comprising a longitudinal center through hole, and a plurality of stop rods spaced around the longitudinal center through hole of said hand wheel, said barrel comprising a longitudinal center through hole, four longitudinal slots equiangularly spaced around the periphery in communication with the longitudinal center through hole of said barrel, a block raised around one end of the longitudinal center through hole of said barrel, an outward flange connected to the block of said barrel at an outer side around the longitudinal center through hole of said barrel and received within the outward annular flange of said socket, four equally spaced inside notches respectively and longitudinally aligned with said longitudinal slots and respectively engaged with the stop rods of said hand wheel, an inside longitudinal groove on the outward flange of said barrel corresponding to the triangular stop block of said socket, a locating hole on the outward flange of said barrel opposing said inside longitudinal groove, a substantially arched wire rod having one end fastened to said locating hole and an opposite end fastened to said inside longitudinal groove, and four round rods respectively inserted into said longitudinal slots and revolvably attached to the four angles of the rectangular chamber of said socket; and a shaft inserted through the longitudinal center through hole of said hand wheel and the longitudinal center through hole of said barrel and fastened to the bottom center hole of said socket by a clamp;

wherein when said hand wheel is turned to move said wire rod to the left side relative to said triangular stop block of said socket, said shaft can be turned clockwise by said handle to drive a workpiece, and said handle will run idle when turned counter-clockwise; when said hand wheel is turned to move said wire rod to the right side relative to said triangular stop block of said socket, said shaft can be turned counter-clockwise by said handle to drive a workpiece, and said handle will run idle when turned clockwise.

2. The reversible screwdriver according to claim 1, further comprising a rubber ring sealingly interposed between said screw cap and the first end of said hollow handle.

3. The reversible screwdriver according to claim 1, wherein the inside longitudinal groove extends radially outward in said outward flange of said barrel from one of said inside notches.

4. The reversible screwdriver according to claim 3, wherein said locating hole is formed in the outward flange of said barrel directly radially outwardly of another of said inside notches which is arranged directly opposite said one of said inside notches.

* * * * *